US006291079B1

(12) United States Patent
Mallen Herrero et al.

(10) Patent No.: US 6,291,079 B1
(45) Date of Patent: Sep. 18, 2001

(54) METHOD FOR MANUFACTURING SELF-HARDENING STEEL WIRE, REINFORCING WIRE AND APPLICATION TO A FLEXIBLE DUCT

(75) Inventors: José Mallen Herrero, Paris; François Ropital, Rueil-Malmaison, both of (FR)

(73) Assignees: Institut Francais du Petrole, Rueil-Malmaison cedex; Coflexip, Paris, both of (FR)

( * ) Notice: Subject to any disclaimer, the term of this patent is extended or adjusted under 35 U.S.C. 154(b) by 0 days.

(21) Appl. No.: 09/254,486

(22) PCT Filed: Sep. 8, 1997

(86) PCT No.: PCT/FR97/01578

§ 371 Date: May 10, 1999

§ 102(e) Date: May 10, 1999

(87) PCT Pub. No.: WO98/10113

PCT Pub. Date: Mar. 12, 1998

(30) Foreign Application Priority Data

Sep. 9, 1996 (FR) ..... 96 10976

(51) Int. Cl.[7] ..... C21D 8/06; C22C 38/00

(52) U.S. Cl. ..... 428/606; 148/320; 148/333; 148/334; 148/335; 148/595; 148/598; 148/600; 148/601; 148/607; 428/544; 428/684

(58) Field of Search ..... 148/595, 598, 148/600, 601, 607, 320, 333, 334, 335; 428/544, 606, 684

(56) References Cited

U.S. PATENT DOCUMENTS

| | | | | |
|---|---|---|---|---|
| 4,578,124 | * | 3/1986 | Yutori et al. | 148/12 F |
| 5,117,874 | * | 6/1992 | Ochiai et al. | 138/140 |
| 5,141,570 | * | 8/1992 | Yutori et al. | 148/320 |
| 5,213,637 | * | 5/1993 | Mallen Herrero et al. | 148/599 |
| 5,342,700 | * | 8/1994 | Armaud et al. | 428/625 |
| 5,904,787 | * | 5/1999 | Matsumoto et al. | 428/544 |
| 5,922,149 | * | 7/1999 | Mallen Herrero et al. | 148/598 |

* cited by examiner

*Primary Examiner*—Archene Turner
(74) *Attorney, Agent, or Firm*—Antonelli, Terry, Stout & Kraus, LLP

(57) ABSTRACT

The invention concerns a method for manufacturing steel wire comprising the following steps: manufacturing a reinforcing wire of sizeable length by rolling or hot wire drawing from steel containing the following elements: 0.18% to 0.45 % C, 0.4% to 1.8% Mn, 1% to 4% Cr, 0.1% to 0.6% Si, 0% to 1.5% Mo, 0% to 1.5% Ni, at most 0.01% S and 0.02% P, the reinforcing wire having, after being rolled or hot drawn, a temperature at least higher than the AC3 temperature, preferably by 50 to 200° C. and in particular by 100 to 150° C.; winding the wire in reels before air cooling the raw manufacturing wire to obtain a HRC hardness not less than 40 and preferably higher than 45. In a variant, the method consists in quenching and tempering so that the wire has a hardness between 20 HRC and 35 HRC. The invention also concerns a reinforcing wire and a flexible tube for carrying effluents.

25 Claims, No Drawings

METHOD FOR MANUFACTURING SELF-HARDENING STEEL WIRE, REINFORCING WIRE AND APPLICATION TO A FLEXIBLE DUCT

FIELD OF THE INVENTION

The present invention concerns elongate elements of sizeable length such as steel wire for reinforcing flexible ducts intended for carrying effluents under pressure. The invention concerns a method for manufacturing such reinforcing wire, the wire obtained by means of the method and the flexible ducts comprising such reinforcing wire in their structure.

BACKGROUND OF THE INVENTION

There are well-known applications wherein flexible ducts reinforced with reinforcement layers consisting of steel wire are used for carrying fluids, notably hydrocarbons. In some cases, these ducts are placed under conditions where they are subjected to a corrosive environment, for example in the presence of acid fluids comprising sulfur-containing products. Furthermore, in cases where such flexible ducts are placed at great water depths, they must have increasingly high mechanical performances in terms of resistance to the inside pressure, the axial load, the outside pressure due to the great depth of immersion.

In flexible ducts, sealing being provided by one or more polymer sheaths, the mechanical resistance to the inside and outside pressure and to the external mechanical stresses is provided by one or more reinforcement layers consisting of steel wire or sections having a specific profile.

Generally, the flexible tube comprises at least one of the following reinforcement layers: an outside pressure resistance casing made of wire or steel sections arranged at an angle close to 90° to the axis, an inside pressure resistance layer (referred to as pressure layer) arranged at an angle greater than 55°, the elongate elements of the casing and of the pressure layer being preferably made of attachable wires, and at least one tensile resistance reinforcement layer arranged with an angle smaller than 55°. According to another method, the pressure layer and the tensile resistance reinforcements are replaced by two symmetrical reinforcement layers at an angle of about 55°, or by two pairs of reinforced layers at 55°, or by a series of at least two layers, the angle of reinforcement of at least one layer being less than 55° and the angle of reinforcement of at least one other layer being greater than 55°. The steel of the wire forming the reinforcement must be so selected that, considering the cross-section thereof, the wire provides the required mechanical strength during operation while withstanding corrosion, in particular in some cases in the presence of $H_2S$.

These steel wires, generally shaped by hot or cold rolling or drawing, can have various profiles or cross-sections: substantially flat or half-flat, U, T or Z-shaped, with or without means for fastening to a neighbouring wire, or circular.

In case of use in the presence of acid gas, mainly $H_2S$ and $CO_2$, problems linked with the penetration of hydrogen in the steel can arise in addition to generalized corrosion. In fact, $H_2S$ (or rather the $HS^-$ ion) is a recombination inhibitor for the hydrogen atoms produced by reduction of the protons at the surface of the steel. These hydrogen atoms enter the metal and recombine therein, thus being at the origin of two types of deterioration:

- blisters below the surface of the steel (hydrogen blistering), or internal cracking (referred to as stepwise cracking) that can appear in the absence of stresses and that can be worsened in the presence of residual stresses,
- embrittlement resulting in delayed fractures in cases where the steel is subjected to stresses (stress corrosion by hydrogen).

NACE standards have been provided to assess the ability of a structural steel element to be used in the presence of $H_2S$. The steels must be subjected to a test on a representative sample, under stress in an $H_2S$ medium with a pH value ranging from 2.8 to 3.4 (NACE Test Method TM 0177 relative to the effects of stress corrosion cracking, commonly referred to as Sulfide Stress Corrosion Cracking or SSCC), so as to be able to be considered usable for manufacturing metallic structures withstanding the effects of stress corrosion in the presence of $H_2S$.

Another NACE standard (TM 0284) relates to the cracking effects induced by hydrogen, commonly referred to as <<Hydrogen Induced Cracking>> or HIC. The testing procedure recommended by the above-mentioned standard consists in exposing samples, without stress, to a sea-water solution saturated with $H_2S$, at ambient temperature and pressure, at a pH value ranging between 4.8 and 5.4. The procedure holds that metallographic examinations are to be performed thereafter in order to quantify cracking of the samples, or to record the absence of cracking.

As subsea reservoir development conditions have become increasingly severe, it recently appeared that material qualification for use in the presence of $H_2S$ should be aimed at more acid media, since the pH value can be as low as about 3. This has thus led to specify that, in some cases, the tests according to the NACE TM 0284 standard should be carried out in a $H_2S$ saturated solution with a pH value of 3 or 2.8 for example, similar to the solution defined by the NACE TM 0177 standard, and no longer with a pH value at least equal to 4.8.

According to currently known techniques, the reinforcement wires of flexible pipes, in particular for carrying fluids containing $H_2S$, are made with soft or medium carbon-manganese steels (0.15 to 0.50% carbon) with a ferrite-pearlite structure, that are subjected, after cold forming of the rolled wire, to a suitable annealing treatment in order to bring the hardness to the allowed value, if necessary.

The NACE 0175 standard defines that such carbon-manganese steels are compatible with a $H_2S$ medium if their hardness is less than or equal to 22 HRC.

It has thus been checked that reinforcing wires such as those described above, made of carbon-manganese steel and having a ferrite-pearlite structure, can be manufactured by cold forming followed by annealing so as to meet the conventional NACE criteria. A well-known process described in document FR-A-2,661,194 allows to obtain a steel of hardness higher than 22 HRC compatible with $H_2S$ according to the NACE TM 0177 and TM 0284 standards, the solution used for the tests according to TM 0284 having a pH value ranging between 4.8 and 5.4.

On the other hand, it has been observed that carbon steels with a ferrite-pearlite structure are incapable of withstanding satisfactorily the HIC tests carried out according to the procedure of the TM 0284 standard when these tests are carried out in a more acid medium, for example with a pH value of the order of 3 corresponding to the conditions henceforth encountered in certain oil reservoir development cases. These unacceptable results are obtained even in cases where the final thermal treatment is more extensive in order to obtain a HRC hardness below 22 HRC.

The manufacture of reinforcing wires for flexible ducts thus requires a steel that is, on the one hand, compatible with $H_2S$ under the new conditions described above and, on the other hand, that has a relatively conventional and little sophisticated composition and production procedure in order to maintain the manufacturing costs at a sufficiently low level.

Furthermore, the steels and the manufacturing processes used for making reinforcing wires for flexible ducts must be such that the reinforcing wire can be produced in very long continuous lengths of the order of several hundred meters or several kilometers. The wire thus manufactured is wound on reels in order to be used at a later stage to produce the reinforcing layers of the flexible ducts. Besides, and despite the very great unit length of the wires thus produced, it is important that they can be welded together during the reinforcing operation achieved during the manufacture of the flexible duct. In order to restore the specified properties of the steel in the weld zone, in particular resistance to $H_2S$, a thermal treatment is to be applied after welding. It is however important, in order not to excessively overload the manufacturing costs, that this thermal treatment after welding allows to reach the objective set within a sufficiently short period of time, of the order of several minutes if possible, preferably less than 30 minutes.

In cases where compatibility with $H_2S$ is not required <<sweet crude>> production), carbon steels as cold formed also having a ferrite-pearlite structure, but with substantially higher mechanical strength and hardness values, are commonly used. However, it has been observed that the increase in the mechanical strength beyond certain limits leads, for such steels, to an insufficient ductility considering the reforming and reinforcing operations to be achieved with the reinforcing wire.

In the claimant's patent application FR-95/03,093, the reinforcing wire is hardened in a liquid, typically water or oil, which requires high-precision control of the hardening operating conditions and might make wire manufacturing operations more difficult.

The object of the present invention is to describe a process allowing to obtain an elongate element of sizeable length intended for manufacture of flexible tubes, the elongate element having optimized mechanical characteristics and, in an application according to the invention, a good resistance to $H_2S$.

SUMMARY OF THE INVENTION

The present invention concerns a method for manufacturing a steel reinforcing wire, this wire being of sizeable length and able to be used as a reinforcing wire for a flexible duct. The method comprises the following stages:

manufacturing a reinforcing wire of sizeable length by rolling or hot wire drawing from steel containing the following elements:
0.18% to 0.45% C, preferably 0.20 to 0.40% C,
0.4% to 1.8% Mn preferably 0.45 to 1.50% Mn,
1 to 4% Cr, preferably 1.5 to 3.5% Cr,
0.1% to 0.6% Si, preferably 0.1 to 0.5% Si,
0 to 1.5% Mo, preferably 0.25 to 1% Mo,
0 to 1.5% Ni, preferably 0 to 0.7% Ni,
at most 0.01% S and 0.020% P, the steel can also contain dispersoids, in particular vanadium, with $V \leqq 0.1$, or possibly V ranging between 0.1 and 0.15 if the wire is not to be welded, the reinforcing wire having, after being rolled or hot drawn, a temperature at least higher than the AC3 temperature, preferably by 50 to 200° C., and in particular by 100 to 150° C., winding the wire in reels, and air cooling of the wire reel to obtain a HRC hardness not less than 40 and preferably greater than or equal to 45, and that can advantageously reach or exceed 50.

The structure of the steel of the reinforcing wire thus obtained can preferably be of the martensite-bainite type, preferably predominantly bainitic.

The amount of ferrite is preferably small, in particular less than or equal to 10%, and advantageously less than or equal to 1%.

Rolling or hot drawing of the reinforcing wire can be performed from a previously rolled wire bar or wire brough to the transformation temperature by means of suitable furnaces.

The air hardening level of the wire in reels mainly depends on the steel grade and on the cooling conditions. The main parameters defining the cooling conditions are notably: the temperature at the end of the rolling process, the cross-section of the wire, the amount of wire and the compactness of the reel, the cooling dynamics. Selection of the cooling systems and mode is conditioned by the steel grade, the cross-section and the amount of wire. Slow air type cooling corresponds for example to fast handling of the reel after rolling. Rapid or pulsated type air cooling corresponds for example to ventilation of the reel by blower or pulsated air. In another variant, the reel can be ventilated under a bell jar. When the amount of wire is such that the reel load exceeds 500 to 700 kg, rapid or pulsated type air cooling is advantageously used.

The structure obtained afetr cooling is preferably predominantly bainitic with a martensite proportion ranging between 0 and 30%. The bainite is preferably in the lower bainite state and not in the higher bainite state. The structure can preferably comprise only a small proportion of ferrite, preferably less than or equal to 10%, advantageously less than or equal to 1%.

One advantage of the method according to the invention lies in the fact that its industrial implementation can be relatively economically and readily achieved. In particular, in relation to steel wires made by cold forming followed by conventional hardening in a liquid, typically water or oiL by means of the method according to the invention, characterized by hot forming followed by air hardening, the characteristics of the wire obtained are less sensitive to possible variations of the various parameters involved in the air hardening operation, concerning either the austenitizing temperature adjustment or the cooling device adjustment. It is thus possible, relatively readily and steadily, with a limited risk of defect appearance, to obtain the desired qualities, in particular the absence of quench crack, high resistance and, in the case of the embodiment described hereafter, a good resistance of the steel, after tempering heat treatment, to corrosion in the presence of $H_2S$.

The wire thus obtained may not be able to resist $H_2S$ under certain production conditions, but it can be used very advantageously, in particular possibly after a stress-relief heat treatment, as a reinforcing wire for flexible ducts thanks to its excellent optimized mechanical properties, in particular by combination of a high mechanical strength and of a higher ductility than that obtained with known processes. The breaking strength Rm can reach 1000 to 1600 Mpa, equal to or greater than that of the most resistant reinforcing wires currently known, and the ultimate elongation can be higher than 5%, possibly higher than 10% and it can exceed 15% in some cases, whereas the ultimate elongation of the known steel wires of ferrite-pearlite structure having a comparable resistance level in the cold drawn state does not exceed 5%.

The invention thus allows to obtain a reinforcing wire having, after air cooling, a predominantly bainitic structure relatively homogeneously throughout the thickness of the wire, despite wire thickness increase. A total amount of bainite and martensite commonly at least equal to 90% and, in the most favourable cases, reaching approximately 100%, can thus be obtained in such a predominantly lower bainitic structure with a proportion of martensite ranging between 0 and 30%.

Such a result is obtained by using a steel grade suited to the air hardenability.

The table hereafter sums up, in order of magnitude, the results obtained in the case of three different grades corresponding to the examples described in detail hereunder.

The values given in the table correspond to typical mean values for a wire sample wound in reel and after cooling, i.e. air hardened, according to the steel grade used.

| | Steel grade | | |
|---|---|---|---|
| | 35CDV6 | 30CD12 | 22CD12 |
| HRC | 50 | 45 | 42 |
| Rp 0.2 (MPa) | 1100 | 1000 | 850 |
| Rm (MPa) | 1800 | 1500 | 1350 |
| Ultimate elongation A (%) | 13.5 | 15 | 12.5 |
| Striction Z (%) | 48 to 55 | 57 to 62 | 56 to 59 |

Although relatively lower, the values of the yield limit Rp0.2 and of the mechanical breaking strength Rm of the 22CD12 grade still are very high and interesting for use as a reinforcing wire in a flexible duct. The wires according to the invention have remarkably high ultimate elongation and striction values in relation to the steel wires known for this use, which is of great interest for flexible ducts.

It has been found that the method according to the invention allows to obtain interesting results when using a steel whose composition is such that the carbon equivalent has a value at least equal to 0.75 and preferably at least equal to 0.85, the carbon equivalent being calculated according to the formula as follows:

$$C_{eq} = C + \frac{Mn}{6} + \frac{Cr + Mo + V}{6} + \frac{Cu + Ni}{15}$$

This carbon equivalent formulation is well-known in the art but it is generally used in order to determine for the steel considered, instead of a minimum carbon equivalent as in the present invention, a maximum value so as to facilitate welding by hardness decrease in the thermally affected zones and to do without thermal treatment after welding.

By comparison with the wires described in patent application FR-95/03,093, which are subjected to a hardening operation in a liquid after rolling, the steel grades being 30CD4, 12CD4, 20C4 and 35C1, the wires then have a composition characterized by a carbon equivalent generally ranging between 0.5 and 0.6 and not exceeding 0.75.

Furthermore, application FR-95/03,093, which notably describes manufacture of the reinforcing wire by cold forming and hardening in a liquid, also proposes a wire manufacturing variant by hot forming necessarily followed by hardening in a liquid, but in this case it is specified that the wire must have a breaking strength Rm less than or equal to 850 MPa after hot rolling, whereas in the present invention, the reinforcing wire after hot rolling has a hardness of at least 40 HRC corresponding to a Rm of at least 1200 MPa.

Manufacture of the reinforcing wire advantageously ends with a stress-relief treatment that can be carried out at a relatively low temperature of the order of 180 to 200° C. This procedure brings a double advantage

- it is easy and inexpensive, the wire reel after air hardening can be directly deposited in a drying oven,
- the yield limit and the breaking strength are not reduced, the yield limit can even be slightly increased.

According to a particular embodiment of the invention allowing to obtain optimized reinforcing wires resistant to $H_2S$, the method can comprise, after cooling of the reel, possibly completed by a stress-relief treatment, a final tempering treatment under determined conditions in order to obtain a hardness greater than or equal to 20 HRC and less than or equal to 35 HRC, preferably greater than or equal to 22 HRC and less than or equal to 28 HRC, and more particularly less than or equal to 26 HRC, the tempering operation resulting in the conversion of the predominantly lower bainitic structure into a quenched and tempered type structure having extremely fme carbide nodules in a highly dispersed state in a ferrite matrix stemining from tempering of the bainite-martensite structure.

The conditions of the fmal tempering heat treatment can be adjusted so as to obtain a hardness less than or equal to 28 HRC compatible with production conditions wherein an environment with a pH value close to 3 can be expected.

In any case, after a tempering heat treatment as defined above, including a pH value close to 3, a steel according to the present invention has no blisters or cracks after HIC tests, and no cracking occurs when it is subjected to tests according to the NACE 0177 (SSCC) standard with a tensile stress equal to at least 60% of the yield limit and that can reach about 90% of this limit.

Final tempering can be performed in bundles in a furnace.

The tempering temperature can be at most equal to a temperature lower than the initial austenitizing temperature of the steel by about 10 to 30° C. in order to avoid excessive carbide coalescence that might lead to a decrease in the characteristics.

This hot transformation method has the advantage of inducing reduced manufacturing costs. It also allows to obtain reinforcing wires with larger cross-sections than with cold rolling.

The invention also concerns a reinforcing wire of constant cross-section and of sizeable length, suited to be used as reinforcing wire in a flexible duct, said wire being manufactured from steel containing the following elements:

- 0.18% to 0.45% C, preferably 0.20 to 0.40% C,
- 0.4% to 1.8% Mn, preferably 0.45 to 1.50% Mn,
- 1 to 4% Cr, preferably 1.5 to 3.5% Cr,
- 0.1% to 0.6% Si, preferably 0.1 to 0.5% Si,
- 0 to 1.5% Mo, preferably 0.25 to 1% Mo,
- 0 to 1.5% Ni, preferably 0 to 0.7% Ni,
- at most 0.01% Sand0.020% P,
- the steel can also contain dispersoids, in particular vanadium, with V≦0.1, or possibly V ranging between 0.1 and 0.15, if the wire is not to be welded.

The reinforcing wire has a predominantly lower bainitic type hardened structure with a proportion of martensite ranging between 0 and 50%. The structure can preferably contain only a small amount of ferrite. The wire can have a hardness higher than 40 HRC. The size of the austenitic grain preferably ranges between indices 5 and 12, and advantageously between indices 8 and 11 according to the NF 04102 standard.

In a variant of the invention, the reinforcing wire has a quenched and tempered type structure with extremely fine carbide nodules in a highly dispersed state in a ferrite matrix stemming from tempering of a bainite-martensite structure.

The reinforcing wire can have a cross-section having at least one of the following general shapes: U, T or Z-shaped, rectangular or circular.

The cross-section of the reinforcing wire can have a width L and a thickness e, and the following proportions: L/e greater than 1 and less than 7. The thickness can range between 1 mm and 20 mm, and it can reach 30 mm.

The profile of the reinforcing wire can comprise means for fastening the wire to an adjacent wire.

According to a first embodiment, the reinforcing wire according to the invention can have a bainite martensite structure with a HRC hardness greater than or equal to 40, preferably greater than or equal to 45. The wire thus obtained may not be able to resist $H_2S$ under certain production conditions, but it can be very advantageously used as reinforcing wire for flexible ducts thanks to its excellent optimized mechanical properties, in particular by combination of a high mechanical strength and a higher ductility than that obtained with known processes. The breaking strength Rm can reach 1000 to 1600 MPa, and it is preferably greater than or equal to 1200 MPa. Such a wire can advantageously be used for manufacturing the reinforcement of flexible tubes for carrying sweet crude, dead oil or water. The method for manufacturing such a wire comprises hot transformation, air cooling of the wire obtained and stored in reels after transformation, preferably followed by a stress-relief treatment.

According to another embodiment, the reinforcing wire according to the invention remaining wound in reels is subjected to a tempering treatment so as to have a hardened type structure, with a HRC hardness greater than or equal to 20 and less than or equal to 35, preferably greater than or equal to 22 and less than or equal to 28, and in particular less than or equal to 26. The wire thus obtained can have $H_2S$ resistance properties under the production conditions described above, in particular after HIC tests in a very acid environment (pH value close to 2.8 or 3). The mechanical strength Rm can be of the order of 700 to 900 MPa below a pH value close to 3 and it can reach at least 1100 MPa with a higher pH value. The stress applied during the SSCC tests according to NACE, with a pH value close to 2.8, can be at least 400 MPa and it can reach 600 MPa.

In cases where the SSCC tests are carried out with a pH value higher than 3, the allowable stresses can be higher and reach about 90% of the yield limit.

In order to be used as reinforcing wires in flexible tubes for carrying crude oil containing acid gas, in particular $H_2S$ and $CO_2$, the method according to the invention allows to manufacture steel reinforcing wires of tempered martensite-bainite type whose structure comprises extremely fme carbide nodules in a highly dispersed state in a ferrite matrix stemming from tempering of a martensite-bainite structure. It is interesting to compare this steel with other steels already proposed or used for making reinforcing wires intended for the same use, such as steels obtained by means of a spheroidizing treatment from a cold drawn ferrite-pearlite structure, these steels also containing carbide elements in a ferritic matrix. The spheroidized carbide elements of these steels are considerably less fine and less dispersed as in the case of the steel according to the invention, which allows to clearly identify the difference between the two types of material. Besides, it appears that the higher properties of the reinforcing wire according to the invention, in terms of mechanical strength and of compatibility with $H_2S$, by comparison with the wires of the prior art, in particular made of spheroidized steel, can have a connection with the fact that it has a much fmer and dispersed nodular structure.

Particularly interesting results are obtained by adjusting the hot rolling and tempering conditions, in particular according to the composition of the steel and to the cross-section of the wire, so that the hardness ranges between 22 and 26 HRC, with a yield limit Rp0.2 ranging between 650 and 750 MPa, and a breaking strength Rm ranging between 780 and 860 MPa. In the particular case of three grades corresponding to the examples described in detail hereafter, the table hereunder sums up the typical mean values of the tempering temperatures to be applied for three hours, by comparing them with the AC1 temperatures of each grade.

| | 35CDV6 | 30CD12 | 22CD12 |
|---|---|---|---|
| Tempering temperature (° C.) 3 hours | 680–720 | 660–690 | 620–650 |
| ACl (° C.) | ~730 | ~780 | ~780 |

As mentioned above, the tempering temperature must be lower than the AC1 temperature by at least about 10 to 30° C., this condition resulting from the fact that it has been found that, under such conditions, the tempered wire has very good $H_2S$ resistance characteristics. It can be seen that the 35CDV6 grade requires more accurate adjustment of the tempering temperature.

By comparing the mechanical characteristics after tempering as summed up above ith the mechanical characteristics of the wire in the tempered state, it can be seen that, ven if a wire has a relatively low yield limit in the tempered state, for example 850 MPa in the case of the 22CD 12 grade, instead of 1000 to 1100 for the other grades, this wire, for example in the 22CD12 grade, has a yield limit of the same order as the other grades in the tempered state, which is particularly interesting for application to the reinforcement of flexible tubes. This corresponds, in this case, to the fact that the tempering treatment causes a yield limit reduction that is much lower than the breaking strength reduction, which is very advantageous for manufacturing flexible tubes insofar as their dimensioning is conditioned by the yield limit of the steel wires.

It can be noted that the invention notably has the advantage that, from the same batches of reinforcing wire reels obtained according to the method of the invention, it is possible to manufacture, according to needs, either steel wires of high mechanical strength but that sometimes do not have the required $H_2S$ resistance properties, or wires resisting $H_2S$ even under the harshest conditions. In the first case, the manufacturing program is preferably completed by a stress-relief treatment. In the other case, the manufacturing program is at least completed by an additional final tempering stage.

The invention can be applied to a flexible tube for carrying an effluent containing $H_2S$, and the tube can comprise at least one layer of pressure and/or tensile strength reinforcements comprising reinforcing wires according to the invention.

Other features and advantages of the present invention will be clear from reading the description hereafter of non limitative examples.

DETAILED DESCRIPTION OF THE INVENTION

Table I gives the chemical analysis of three steel grades that can be used according to the method of the present invention; various wire samples have been manufactured in these grades on a trial basis.

Products T10, T14 correspond to a T-shaped cross-section 10 and 14 mm in height, with respective cross-sections of 132 mm2 and 276 $mm^2$.

Product 15*5 corresponds to a 15-mm wide and 5-mm thick wire of rectangular cross-section having a cross-section of 75 $mm^2$.

Products Ø15, Ø16 and Ø19 correspond to a wire of circular cross-section 15, 16 and 19 mm in diameter, having respectively cross-sections of 176 $mm^2$, 201 mm2 and 283 $mm^2$.

TABLE I

| GRADE | PRODUCT | CAST | C | Si | Mn | S | P | Ni | Cr | Mo | V |
|---|---|---|---|---|---|---|---|---|---|---|---|
| 35CDV6 | ϕ6/T10 | (a) | 0.350 | 0.46 | 1.02 | <0.010 | 0.013 | 0.50 | 1.51 | 0.27 | 0.13 |
| (1) | ϕ19 | (b) | 0.367 | 0.48 | 1.29 | 0.009 | <0.01 | 0.54 | 1.58 | 0.25 | 0.13 |
| 22CD12 | 15 × 5 | (c) | 0.234 | 0.33 | 0.52 | <0.003 | 0.009 | — | 2.93 | 0.43 | — |
| (2) | T14/ϕ15 | (d) | 0.222 | 0.28 | 0.49 | <0.003 | 0.010 | — | 2.92 | 0.44 | — |
| 30CD12 | 15 × 5 | (e) | 0.307 | 0.30 | 0.48 | <0.003 | 0.011 | 0.22 | 2.93 | 0.43 | — |
| (3) | ϕ15 | (f) | 0.302 | 0.35 | 0.55 | <0.003 | 0.011 | 0.16 | 3.04 | 0.44 | — |
| | T14 | (g) | 0.306 | 0.33 | 0.66 | <0.003 | 0.012 | 0.20 | 2.95 | 0.44 | — |
| | T10 | (h) | 0.308 | 0.29 | 0.50 | <0.003 | 0.011 | 0.20 | 2.85 | 0.43 | — |

The various products mentioned in Table I were manufactured by hot rolling, at temperatures selected according to the steel grade profile so that the final temperature is higher than temperature AC3, preferably by about 10 to 50° C. The wire reels are slowly air cooled.

The description hereafter shows the good homogeneity of the reels after rolling and air cooling, the mechanical characterization of the products as hot rolled, the definition of the tempering ranges allowing to obtain a HRC hardness ranging between 20 and 30, corresponding by first approximation to Rp0.2 values ranging between 650 and 750 MPa and to Rm values ranging between 800 and 850 MPa.

A) Self-hardening Character of Grades (1), (2), (3), and Homogeneity of the Reels as Rolled and Slowly Air Cooled (Table II):

The reels were cut into three sections: A1–A2, B1–B2, C1–C2 in order to take samples at the top (A1), at the end (C2) and in two intermediate portions (B1 and C1).

TABLE II

| | | Rm (MPa) | Rp 0.2 (MPa) | HRC |
|---|---|---|---|---|
| 35CDV6 | A1 | 1760 | 1030 | 50 |
| Ø19 | B1 | 1754 | 1060 | 50 |
| | C1 | 1742 | 1110 | 50 |
| | C2 | 1984 | 1054 | 53 |
| T10 | A1 | 2200 | 1344 | 55 |
| | B1 | 1851 | 1236 | 52 |
| | C1 | 1927 | 1233 | 52 |
| | C2 | 2172 | 1403 | 55 |
| 22CD12 | A1 | 1392 | 840 | 42 |
| Ø15 | B1 | 1381 | 813 | 43 |
| | C1 | 1387 | 838 | 42 |
| | C2 | 1422 | 862 | 44 |

TABLE II-continued

| | | Rm (MPa) | Rp 0.2 (MPa) | HRC |
|---|---|---|---|---|
| T14 | A1 | 1445 | 896 | 43 |
| | B1 | 1381 | 813 | 42 |
| | C1 | 1398 | 843 | 42 |
| | C2 | 1491 | 911 | 44 |
| 30CD12 | A1 | 1502 | 931 | 42 |
| T14 | B1 | 1524 | 982 | 45 |
| | C1 | 1540 | 1003 | 45 |
| | C2 | 1549 | 1004 | 45 |

The 30CD12 grade has a higher homogeneity in the Rm values, representative of a better hardenability on account of the 0.30% carbon content and of the presence of 0.22% Ni.

In the case of the 35CDV6 grade, the 0.35% carbon content, the 0.5% nickel content and the hardening effect of the 0.13% vanadium content allow to explain the higher Rm values in relation to the other grades.

B) Definition of the Tempering Conditions:

Tables III, IV and V respectively give the mechanical characteristics of the products respectively manufactured with the 35CDV6, 22CD12 and 30CD12 grades, as a function of the approximately 3-hour tempering treatment temperature.

It can be noted that, for the 35CDV6 grade, the tempering conditions allowing to obtain a hardness value ranging between 20 and 25 HRC lead to tempering operations of the order of three hours at a temperature very close to the AC1 point. This particular feature is due to the vanadium content. In cases where wire welding is necessary for the manufacture of the flexible tubes, thermal treatment of the welds poses problems. The wires manufactured from this grade can preferably be reserved for shorter flexible tubes.

TABLE III

| 35CDV6 | | | | | | |
|---|---|---|---|---|---|---|
| Tempering | Wire | Rp0.2 (MPa) | Rm (MPa) | A (%) | Rp/Rm | HRC |
| 3 h at 680° C. | ϕ19 | 758 | 880 | 19.5 | 0.86 | 26–28 |
| | T10 | 866 | 945 | 19.7 | 0.92 | |
| 3 h at 700° C. | ϕ19 | 700 | 830 | 20.7 | 0.84 | 21–26 |
| | T10 | 807 | 878 | 21.7 | 0.92 | |
| 3 h at 720° C. | ϕ16 | 643 | 783 | 24 | 0.82 | 23 |
| | ϕ19 | 487 | 878 | 20.3 | 0.55 | |
| | T10 | 733 | 811 | 24.2 | 0.90 | |

TABLE IV

| 22CD12 | | | | | | |
|---|---|---|---|---|---|---|
| Tempering | Wire | Rp0.2 (MPa) | Rm (MPa) | A (%) | Rp/Rm | HRC |
| 600° C. | ϕ15 | 890 | 1030 | 14.5 | 0.86 | 30 |
| | T14 | 850 | 990 | 15.1 | 0.86 | |
| 630° C. | ϕ15 | 770 | 903 | 16.4 | 0.85 | 26 |
| | T14 | 773 | 910 | 16.2 | 0.85 | |
| 660° C. | ϕ15 | 707 | 835 | 17.5 | 0.85 | 22–24 |
| | T14 | 717 | 839 | 17.2 | 0.85 | |

TABLE V

| 30CD12 | | | | | | |
|---|---|---|---|---|---|---|
| Tempering | Wire | Rp0.2 | Rm | A (%) | Rp0.2/Rm | HRC |
| 3 h at 625° C. | T14 | 795 | 957 | 19 | 0.83 | 30 |
| | T10 | 793 | 979 | 14 | 0.81 | |
| | 15 × 5 | 791 | 961 | 13 | 0.82 | |
| 3 h at 645° C. | T14 | 801 | 943 | 18.7 | 0.85 | 28 |
| | T10 | 745 | 914 | 14 | 0.82 | |
| | 15 × 5 | 760 | 913 | 13 | 0.83 | |
| 3 h at 665° C. | T14 | 715 | 868 | 19.8 | 0.82 | 26 |
| | T10 | 719 | 871 | 16 | 0.83 | |
| | 15 × 5 | 764 | 878 | 14 | 0.87 | |
| 3 h at 675° C. | T14 | 716 | 845 | 20.8 | 0.85 | 24 |
| | T10 | 684 | 837 | 17 | 0.82 | |
| | 15 × 5 | 701 | 849 | 14.5 | 0.83 | |
| 3 h at 685° C. | T14 | 659 | 804 | 21.2 | 0.82 | 22 |
| | T10 | 655 | 806 | 17.5 | 0.81 | |
| | 15 × 5 | 646 | 802 | 16 | 0.81 | |

C) Behaviour in a $H_2S$ medium

35CDV6 Steel 16-mm diameter reinforcing wires of circular cross-section and profile T10 were made from a chromium molybdenum type steel in accordance with the 35CDV6 grade of the AFNOR standard. The composition of cast (a) from which the wires were manufactured is given in Table I.

After austenitizing at a temperature of at least 910° C., then hot rolling and air cooling, we obtain the mechanical characteristics <<as rolled>> mentioned in Tables II and III.

3-hour tempering treatments at 730° C. for the Ø16 mm wire and at 700° C. for wire T10 were carried out and the mechanical characteristics of the SSCC samples are as follows:

| | Rp 0.2 (MPa) | Rm (MPa) | A (%) | Hardness (HRC) |
|---|---|---|---|---|
| Ø16 3 h at 730° C. | 620 | 822 | 21 | 23 |
| T10 3 h at 700° C. | 760 | 825 | 24 | 26 |

The SSCC tests were carried out according to the NACE TM 0177 method A standard (uniaxial stress).

For the treatment at 730° C. (necessary to obtain a 23 HRC hardness), we obtained breaks after several days under 400 and 450 MPa, this failure being explained by the fact that the tempering temperature exceeds the AC1 point temperature (AC1≅720° C.) of this grade. The presence of vanadium (0.13% ) is the cause of this low AC1 temperature.

For the treatment at 700° C., the samples are subjected to the NACE TM 0177 test under a stress of 500 MPa (65% Rp0.2), for 30 days, without any break occurring.

Besides, T10 wires thermally treated for three hours at 715° C. showed non-sensitivity to stepwise cracking according to the HIC NACE TM0284 test with the NACE TM 0177 solution (pH=3).

| | Rp 0.2 (MPa) | Rm (MPa) | Hardness (HRC) |
|---|---|---|---|
| T10 3 h at 715° C. | 724 | 807 | 24 |

22CD12 Steel

Reinforcing wires were manufactured from a chromium molybdenum type steel in accordance with the 22CD12 grade defined by the AFNOR standard. The cast compositions are given in Table I.

A 15-mm diameter wire of circular cross-section was hot rolled, air hardened and tempered for three hours at 650° C. in order to obtain a 25 HRC hardness. A stress-relief treatment was carried out at 630° C. for two hours after air hardening.

| | Rp 0.2 (MPa) | Rm (MPa) | A (%) | Hardness (HRC) |
|---|---|---|---|---|
| Tempering for 3 h at 650° C. | 721 | 857 | 16.5 | 25 |

SSCC tests were carried out according to the NACE TM 0177 method A standard, under a stress of 450 MPa (62% Rp0.2), for 30 days, without any break occurring.

b) Rectangular 15×5 wires were also hot rolled, air hardened and stress-relieved for two hours at 160° C. prior to 3-hour tempering at 655° C. The mechanical characteristics obtained are as follows:

| | Rp 0.2 (MPa) | Rm (MPa) | A (%) | Hardness (HRC) |
|---|---|---|---|---|
| Tempering for 3 h at 655° C. | 676 | 823 | 21 | 25 |

HIC tests according to the NACE TM 0284 standard with the TM 0177 solution (pH=3) showed non-sensitivity to stepwise cracking.

The SSCC characterization was performed according to the NACE TM 0177 method A standard and under constant pH conditions for the solution (pH=3.5) throughout the 30-day test.

The SSCC testing stresses are:

for the TM 0177 A method (pH=3) σ=450 MPa (66% Rp0.2)

for the constant pH method (pH=3.5) σ=600 MPa (90% Rp0.2).

c) T14 reinforcing wires were similarly hot rolled, air hardened, stress-relieved for two hours at 630° C. and subjected to a tempering treatment for three hours at 650° C.

| | Rp 0.2 (MPa) | Rm (MPa) | A (%) | Hardness (HRC) |
|---|---|---|---|---|
| Tempering for 3 h at 650° C. | 706 | 832 | 19 | 24 |

HIC tests carried out according to the NACE TM 0284 standard with the TM 0177 solution (pH=3) show non-sensitivity to stepwise cracking.

30CD12 Steel

Reinforcing wires were manufactured from a chromium molybdenum type steel in accordance with the 30CD12 grade defined by the AFNOR standard. The cast compositions are given in Table I.

a) Rectangular 15×5 reinforcing wires were hot rolled, air hardened, stress-relieved for two hours at 610° C. A 3-hour tempering treatment at 685° C. was applied thereafter.

| | Rp 0.2 (MPa) | Rm (MPa) | A (%) | Hardness (HRC) |
|---|---|---|---|---|
| Tempering for 3 h at 685° C. | 691 | 811 | 19 | 23 |

The SSCC resistance was established according to the NACE TM 0177 method A standard under a stress of 500 MPa (72% Rp0.2). The examinations made after the thirty SSCC test days showed no breaks and no cracks.

b) Rectangular 15×5 reinforcing wires were hot rolled, air hardened and stress-relieved for one hour at 630° C. 3-hour tempering treatments at 685 or 675° C. allowed to obtain hardnesses of 22 or 24 HRC respectively. The corresponding mechanical characteristics are given in Table V.

The SSCC behaviour was established during tests under uniaxial stress with a solution whose pH value was kept constant at 3.5.

For wires of 22 HRC hardness, under the testing stress of 580 MPa (90% Rp0.2), no break appeared after 30 days.

For wires of 24 HRC hardness, under the testing stress of 480 MPa (70% Rp0.2), no break appeared after 30 days.

HIC tests carried out according to the NACE TM 0284 standard with the TM 0177 solution (pH=3) show non-sensitivity to stepwise cracking.

c) TIO reinforcing wires were hot rolled, air hardened and stress-relieved for one hour at 630° C. 3-hour tempering treatments at 685 or 675 or 665 or 645° C. led to 22, 24, 26 or 28 HRC hardnesses respectively (the mechanical characteristics are given in Table V).

The HIC tests carried out according to the NACE TM 0284 standard in the NACE TM 0177 solution (pH=3) showed non-sensitivity to stepwise cracking for these various hardnesses.

The SSCC behaviour was established according to the TM0177 C method standard, i.e. under a stress referred to as <<ring>>. In the C method, the rings are made in such a way that the samples bent by plastic deformation have, in the absence of external forces, a curvature corresponding to that of the spiral reinforcing wire so as to form a pressure layer type reinforcing layer with an inside diameter of 4 inches (101.6 mm).

For the 500 MPa testing stress (70% Rp0.2), the wire of 26 HRC hardness did not break or crack after 30 days.

For the 600 MPa testing stress (87% Rp0.2), the wire of 24 hrc hardness did not break or crack after the 30 days.

What is claimed is:

1. A method for manufacturing a steel wire intended for use as a reinforcing wire for a flexible tube, characterized in that it comprises the following stages:

manufacturing a reinforcing wire of sizeable length by rolling or hot drawing from steel containing the following elements:

0.18% to 0.45% C, 0.4% to 1.8% M, 1 to 4% Cr, 0.1% to 0.6% Si, 0 to 1.5% Mo, 0 to 1.5% Ni, at most 0.01% S and at most 0.02% P, the reinforcing wire having, after being rolled or hot drawn, a temperature higher than the AC3 temperature of the steel, winding the wire in reels, and air cooling said wire reel so as to obtain a HRC hardness greater than or equal to 40.

2. A method as claimed in claim 1, characterized in that after cooling the reel the wire hardness is greater than or equal to 45 HRC.

3. A method as claimed in claim 1, characterized in that the steel of the reinforcing wire contains the following elements:

0.20% to 0.4% C, 0.455% to 1.5% Mn, 1.5% to 3.5% Cr, 0.1% to 0.5% Si, 0.25% to 0.1% Mo, 0 to 0.7% Ni.

4. A method as claimed in claim 1, characterized in that the steel of the reinforcing wire contains at most 0.1% vanadium.

5. A method as claimed in claim 1, characterized in that it comprises a tempering heat treatment under determined conditions so as to obtain a hardness greater than or equal to 20 HRC and less than or equal to 35 HRC.

6. A method as claimed in claim 5, characterized in that the temperature of said final tempering treatment is less than or equal to a temperature that is lower than the initial austenitizing temperature AC1 of the steel by about 10° C.

7. The method of claim 5 wherein the temperature of the final tempering treatment is less than or equal to a temperature that is 30° C. lower than the initial austenitizing temperature AC1 of the steel.

8. A method as claimed in claim 1, characterized in that the wire reel is subjected to a stress-relief heat treatment after air cooling.

9. The method of claim 1, wherein the reinforcing wire has, after being rolled or hot drawn, a temperature that is 50 to 200° C. higher than the AC3 temperature of the steel.

10. A reinforcing wire of constant cross-section and sizeable length, said wire being characterized in that it is made of steel containing the following elements:

0.18% to 0.45% C, 0.4% to 1.8% Mn,

1% to 4% Cr, 0.1% to 0.6% Si, 0 to 1.5% Mo, 0 to 1.5% Ni, at most 0.01% S and 0.020% P, in that it has a predominantly lower bainite type hardened structure with a proportion of martensite ranging between 0 and 50%, and in that it has a hardness greater than 40 HRC.

11. A wire as claimed in claim 10, wherein the maximum proportion of ferrite in the structure is 10%.

12. A wire as claimed in claim 10, characterized in that it comprises the following elements:

0.20% to 0.40% C, 0.45% to 1.5% Mn, 1.5% to 3.5% Cr, 0.1% to 0.5% Si, 0.25% to 1% Mo, 0 to 0.7% Ni.

13. A wire as claimed in claim 10, characterized in that it comprises at most 0.1% vanadium.

14. A wire as claimed in claim 10, characterized in that it has a cross-section having at least one of the following general shapes: U, T, Z-shaped, rectangular or circular.

15. A wire as claimed in claim 14, characterized in that the cross-section of the reinforcing wire has a width L and a thickness e, and it has the following proportions: L/e greater than 1 and less than 7, the thickness ranging between 1 mm and 30 mm.

16. A wire as claimed in claim 14, characterized in that the profile of the reinforcing wire comprises means for fastening the wire to an adjacent wire.

17. A wire as claimed in claim 10, characterized in that the size of the austenitic grain ranges between indices 5 and 12, according to the NF 04102 standard.

18. The wire of claim 17 wherein the size of the austenitic grain is between indices 8 and 11 according to the NF 04102 standard.

19. A flexible tube, characterized in that it comprises at least one reinforcing layer including reinforcing wires as claimed in claim 10.

20. A wire of claim 10, wherein the maximum proportion of ferrite in the structure is 1%.

21. A reinforcing wire of constant cross-section and sizeable length, said wire being characterized in that it is made of steel containing the following elements:

0.18% to 0.4 5% C, 0.4% to 1.8% Mn,

1% to 4% Cr, 0.1% to 0.6% Si, 0 to 1.5% Mo, 0 to 1.5% Ni, at most 0.01% S and 0.020% P, in that it has a quenched and tempered type structure with extremely fme carbide nodules in a highly dispersed state in a ferrite matrix, and in that it has a hardness greater than or equal to 20 HRC and less than or equal to 35 HRC.

22. A wire as claimed in claim 21, characterized in that it has a hardness greater than or equal to 22 HRC and less than or equal to 28 HRC.

23. A wire as claimed in claim 21, characterized in that said structure stems from tempering of a predominantly lower bainite structure with a proportion of martensite ranging between 0 and 50%.

24. A wire as claimed in claim 21, characterized in that it comprises the following elements:

0.20% to 0.40% C, 0.45% to 1.5% Mn, 1.5% to 3.5% Cr, 0.1% to 0.5% Si, 0.25% to 1% Mo, 0 to 0.7% Ni.

25. A wire as claimed in claim 21, characterized in that it comprises at most 0.1% vanadium.

* * * * *